United States Patent [19]

Safranski et al.

[11] 4,018,029

[45] Apr. 19, 1977

[54] PACKAGING APPARATUS

[75] Inventors: Richard W. Safranski; Lloyd Kovacs, both of Sheboygan, Wis.

[73] Assignee: Hayssen Manufacturing Co., Sheboygan, Wis.

[22] Filed: Oct. 7, 1975

[21] Appl. No.: 620,329

[52] U.S. Cl. ..... 53/59 W; 53/131

[51] Int. Cl.[2] ..... B65B 1/32; B65B 61/26

[58] Field of Search ..... 53/59 W, 131

[56] References Cited

UNITED STATES PATENTS

| | | | |
|---|---|---|---|
| 3,293,824 | 12/1966 | Dorr | 53/131 |
| 3,498,020 | 3/1970 | Eppenberger | 53/131 X |
| 3,540,971 | 11/1970 | Johanski | 53/131 X |

*Primary Examiner*—Travis S. McGehee

*Attorney, Agent, or Firm*—Koenig, Senniger, Powers and Leavitt

[57] ABSTRACT

Packaging apparatus of the form-fill-seal type having a plurality of scales each adapted to weigh out a batch of product for delivery to a package being formed, with means for marking on each package a code identifying the scale which weighed out the batch that went into that package.

20 Claims, 9 Drawing Figures

PACKAGING APPARATUS

BACKGROUND OF THE INVENTION

This invention relates to packaging apparatus, and more particularly to a form-fill-seal packaging machine having a plurality of means each adapted to measure out a batch of a product to be packaged for delivery to a package.

The invention is especially applicable to vertical form-fill-seal packaging machines having a vertical tubular mandrel around which flexible heat-sealable packaging material is formed into tubing, and vertically reciprocable jaws for pulling the tubing down from the mandrel in package length increments, forming package end seals, and severing the tubing at the seals, and wherein the filling of the packages is carried out by means of a plurality of scales each adapted to weigh out a batch of a product to be packaged and adapted to deliver the weighed-out batch to the mandrel for delivery therethrough to a package being formed. With a plurality of scales instead of a single scale, a number of scales may be weighing out batches while one scale is discharging a batch, so as to increase the rate of production of packages. In certain instances, the scales are located above the mandrel and discharge directly into a funnel at the upper end of the mandrel for delivery of each batch through the mandrel to a package being formed. In other instances, the scales are located below the level of the upper end of the mandrel and discharge into buckets of a bucket conveyor which conveys the batches up to the the funnel for discharge of the batches one at a time into the funnel in timed relation to the formation of the packages. Present multiple-scale form-fill-seal apparatus of the class described presents the problem that, if any scale is misweighing the product, it is difficult or at least inconvenient to determine which of the scales is out of tolerance. For example, it may be necessary to check each of the scales, and this results in excessive down time of the form-fill-seal machine.

SUMMARY OF THE INVENTION

Among the several objects of this invention may be noted the provision of packaging apparatus of the class described having multiple-means for measuring out a batch of product for delivery to a package (e.g., multiple scales or multiple volumetric measuring apparatus) and means for enabling ready identification of which measuring means measured out the product contained in each package, thereby enabling ready identification of which measuring means is mismeasuring the product; the provision of such means which may be readily incorporated in original equipment or in previously manufactured machines with only minor modifications of the machines; the provision of such means readily adaptable to various numbers of measuring means; and the provision of such means which is of relatively simple and inexpensive construction, reliable in operation, and which cannot cause any damage to the packages or the product therein. Other objects and features of this invention will be in part apparent and in part pointed out hereinafter.

In general, packaging apparatus of this invention comprises a plurality of means each adapted to measure out a batch of product for delivery to a package, means for delivering the batch measured out by any one of the measuring means to a package, and means operable in accordance with the delivery of each batch to a package for marking on that package a code designating the particular measuring means which weighed out that batch.

BRIEF DESCRIPTION OF THE DRAWINGS

Corresponding reference characters indicate corresponding parts throughout the several views of the drawings.

DESCRIPTION OF A PREFERRED EMBODIMENT

Figure 1:
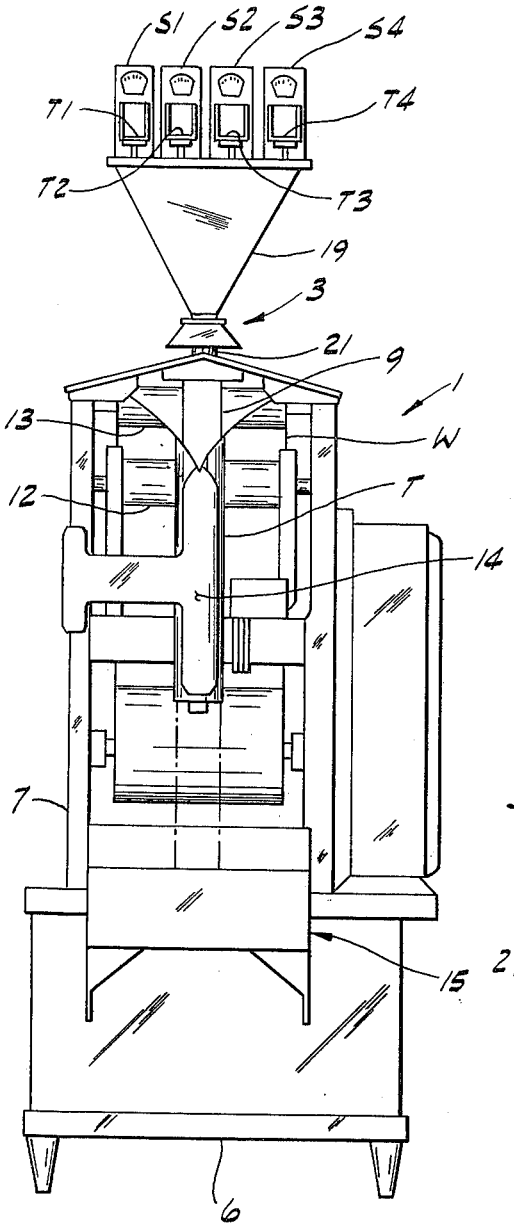
FIG. 1 is a front elevational view of packaging apparatus of this invention having a plurality of scales for weighing out batches of product for delivery to packages being formed and coding means for marking each package so as to designate which scale weighed out the product contained in the package.
Figure 2:
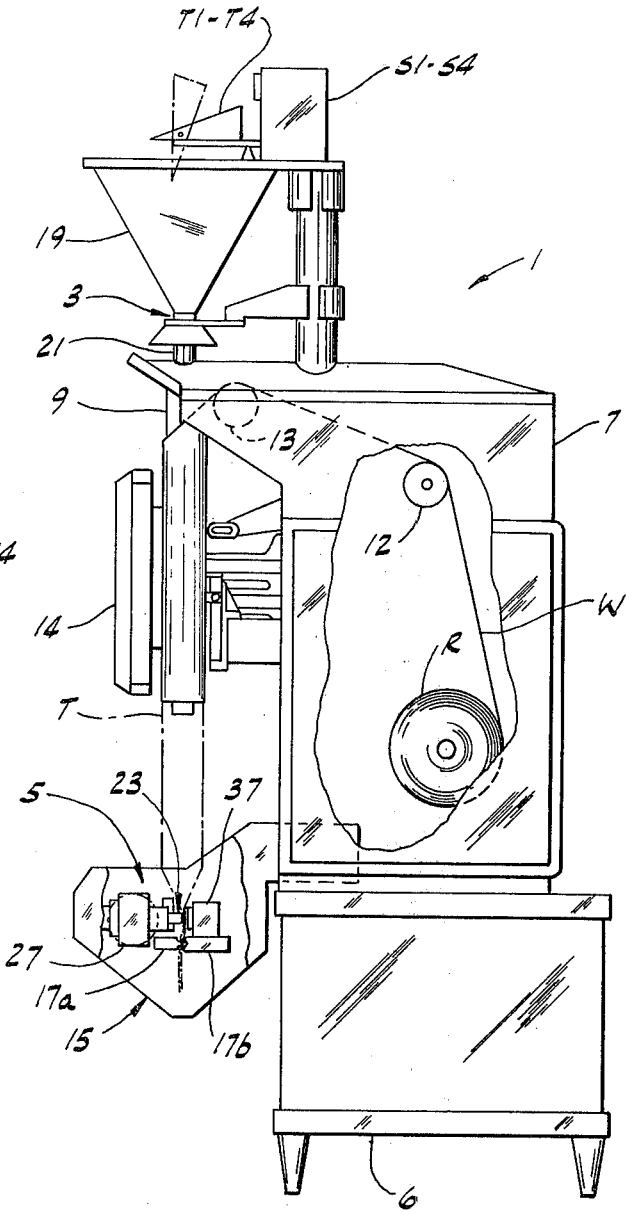
FIG. 2 is a side elevational view of the apparatus of FIG. 1.

Referring to the drawings, first more particularly to FIGS. 1 and 2, packaging apparatus of this invention, indicated generally in its entirety at 1, is shown to comprise a plurality (e.g., four) scales designated S1 – S4, each of which is adapted to weight out a batch of product for delivery to the package P, such as a bag or other container, being formed. Scales S1 – S4 constitute a plurality of means for measuring (i.e., weighing) out batches of product. It will be understood, however, that other multiple measuring means, such as pumps, measuring cups, or counters, may be used to measure out batches of product for delivery to the package if the volume or count of the items rather than the weight of the batch is to be measured. As indicated generally at 3, means is provided for delivery of the batch of product weighed out by any of the scales to the package. In accordance with this invention, means generally designated at 5 (see FIG. 2) is provided for marking on each package formed a code designating the particular scale weighed out that batch. This last-mentioned means may be referred to as coding means.

More particularly, the apparatus 1 is shown to be a multiple-scale, vertical form-fill-and-seal packaging machine in which a web W of flexible packaging material, such as a suitable heat-sealable plastic film or the like, is formed into tubing T, and the tubing is intermittently advanced in package-length intervals with a dwell between successive feed cycles. Transverse seals constituting package end seals are formed across the tubing at package-length intervals. The tubing is severed in the seal zone simultaneously with forming the seal so that the mouth seal of a previously filled bag and the bottom seal of the next bag to be filled are simultaneously formed.

Generally, packaging machine 1 comprises a base 6 and a frame 7 extending up from the base. The drive for the machine is enclosed within base 6. At 9 is indicated a cylindrical mandrel which is mounted in vertical position at the front of frame 7. A supply roll R of web W is mounted at 11 on the frame. The web is fed from the roll around guide rollers 12 and 13 to the upper end of mandrel 9. The mandrel is appropriately equipped with suitable guides for wrapping the web around the mandrel and for forming it into tubing extending down along the mandrel as will be readily understood by those skilled in the art. The margins of the web when formed into tubing are heatsealed together by a longitudinal sealer 14 positioned in front of the mandrel. At 15 is indicated a carriage adapted to reciprocate vertically upward and downward toward and away from the lower end of mandrel 9. This carriage carries a pair or horizontal seal jaws or bars 17*a*, 17*b* on opposite sides of the tubing relatively movable toward and away from one another for forming the above-mentioned package and seals. These seal bars are adapted on the downstroke of the carriage to close on tubing T below the lower end of the mandrel to form a transverse seal across the tubing while pulling down one package length of tubing from the lower end of the mandrel. Seal bars 17*a*, 17*b* may be provided with a suitable cutter (not shown) for severing the tubing in the manner hererofore described. At the end of the downstroke of the carriage, seal bars 17*a*, 17*b* open and the carriage then moves upwardly through an upstroke for the next cycle of the carriage, the tubing dwelling in place during the upstroke.

A batch of product weighed out by one of the scales S1 – S4 is delivered to a package being formed via a funnel 19 leading to a vertical product delivery tube 21 at the upper end of the mandrel 19. Each of these scales S1 – S4 has a tray or other means T1 – T4, respectively, for receiving product being weighed. Each tray is automatically dumped in sequence if the product weighed out by the scale attains a predetermined minimum weight. The trays may be supplied with product in any suitable manner as will be understood by those skilled in the art. It will be noted that only one tray at a time dumps to fill a bag being formed. It will be understood that machines with other scale arrangements may be used. As shown, scales S1 – S4 are mounted on frame 7 above mandrel 9, but it will be understood that they may be suspended from the ceiling above the machine, or they may be mounted on the floor below funnel 19. In the latter case, the scales after weighing out their respective batches of product simultaneously dump into respective buckets (not shown) of a bucket conveyor (also not shown) for transporting the product to funnel 19, the buckets being dumped sequentially into the funnel at predetermined times during the operational cycle of the machine so that a batch of product is delivered to a bag being formed at the proper time.

Figure 5:
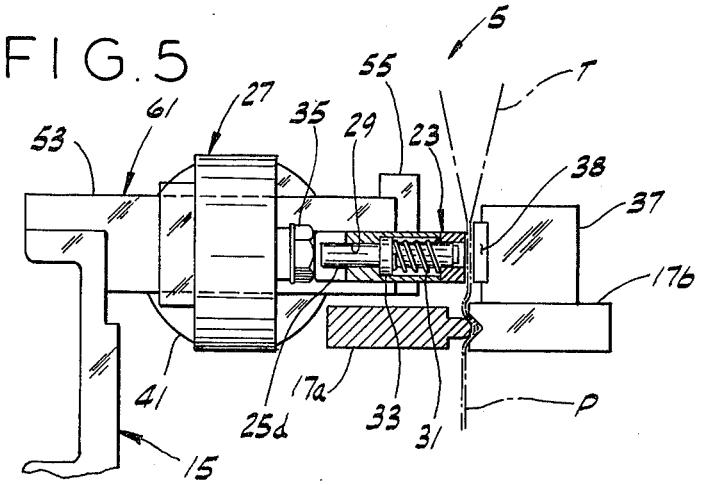
FIG. 5 is a vertical section taken on line 5—5 of FIG. 4.
Figure 6:
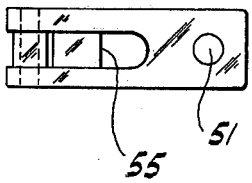
FIG. 6 is a view taken on line 6—6 of FIG. 3.
Figure 3:
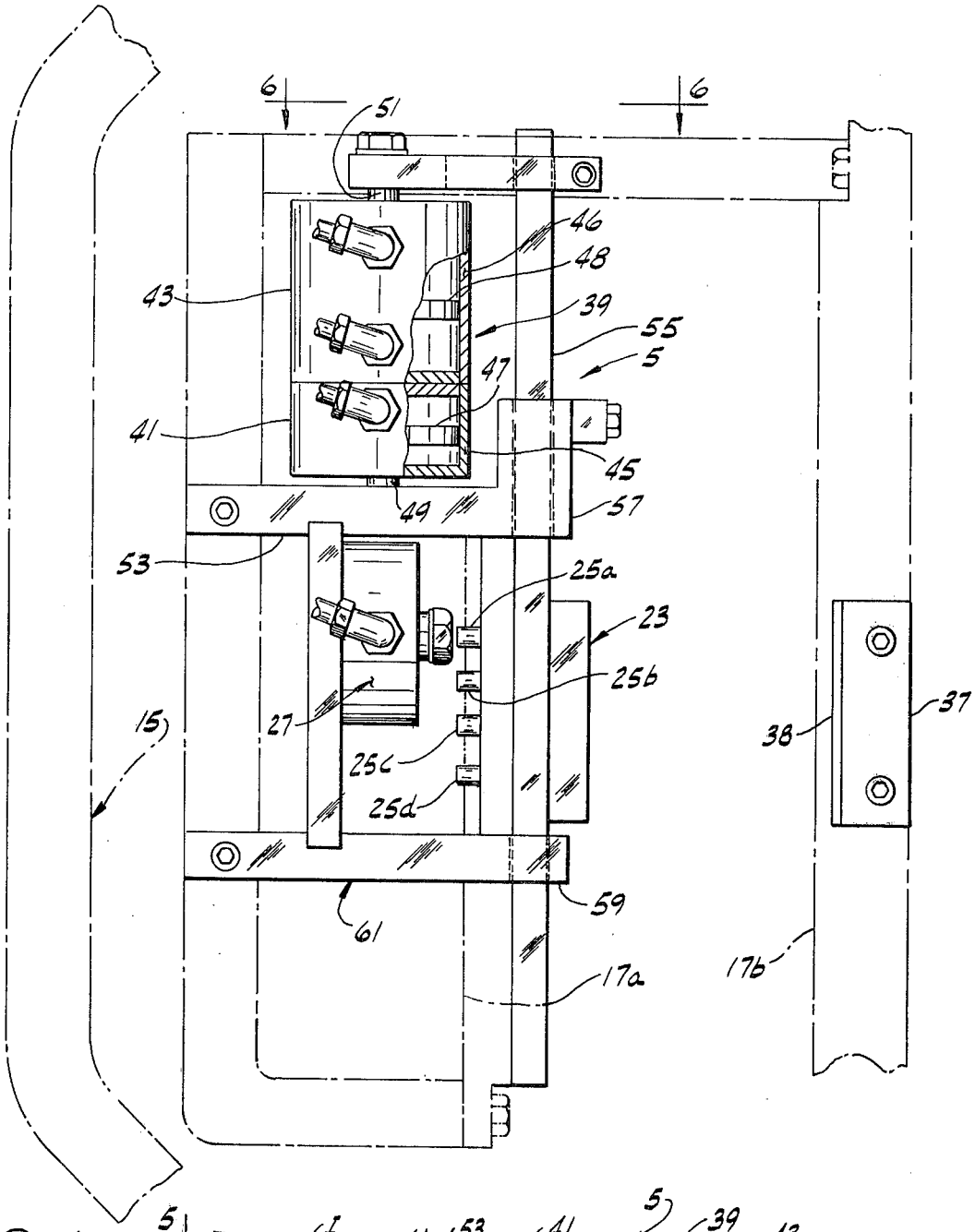
FIG. 3 is an enlarged horizontal sectional view taken on line 3—3 of FIG. 2 showing the coding means.
Figure 4:
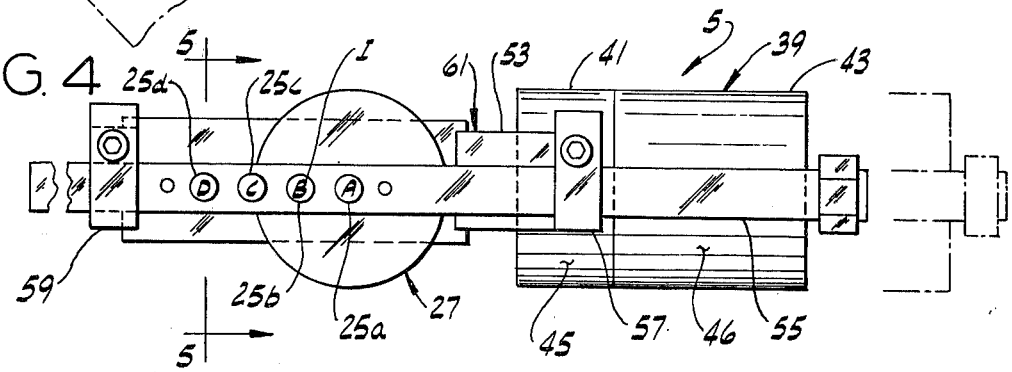
FIG. 4 is a view taken on line 4—4 of FIG. 3.

Referring now to FIGS. 3–6 coding means 5 is shown to comprise a printing head 23 having a plurality (e.g., four) of printing elements 25*a*–25*d* and an air cylinder 27 constituting means for actuating the printing elements. As will be hereinafter described, air cylinder 27 is operable in accordance with the delivery of a batch of product to the bag being formed for actuating a selected printing element 25*a*–25*d* so as to mark the package being formed with a code. Printing head 23 has a printing element for each scale S1 – S4. Each printing element has raised inidicia I on its outer end for embossing indicia I on a bag when actuated to designate which scale weighed out the product contained in that bag. While indicia I is preferably embossed on package P, it will be understood that any marking or printing method may be used to mark the code on the package. As shown in FIG. 5, each printing element is a plunger movable axially in a respective bore 29 in printing head 23 between a retracted position and an extended printing position (not shown) in which with sealings bars 17*a*, 17*b* closed, the outer end of the printing element engages tubing T for imprinting indicia I thereon. The printing element is biased toward its retracted position by a compression coil spring 31 surrounding the printing element in bore 29 and interposed between the printing head and a flange 33 on the printing head for engagement by the piston or actuating rod 35 of air cylinder 27 to effect axial movement of one of the printing elements from its retracted position to its printing position. As shown in FIGS. 3 and 4, printing elements 25*a*–25*d* are arranged horizontally relative to one another and are equally spaced from one another in the printing head.

Air cylinder 27 is a double-acting unit having a piston or actuating rod 35 extending endwise therefrom. Air cylinder 27 is positively moved between its extended and retracted positions by air pressure in a manner as will appear. Air cylinder 27 is fixedly mounted on sealing bar 17*a* and printing head 23 is movable laterally on sealing bar 17*a* relative to the air cylinder unit between a plurality of discrete printing positions in which a respective printing element 25*a*–25*d* is in register with piston rod 35 for actuation thereby and for marking a bag as the transverse seals are formed across tubing T. Both the printing head and air cylinder 27 are movable with the sealing bar 17*a* toward and away from sealing bar 17*b* as the sealing bars are cycled for forming the above-mentioned package end seals on the tubing. A platen 37 having a resilient back-up pad 38 is secured to sealing bar 17*b* for engagement by a printing element 25*a*–25*d* with the tubing T disposed therebetween, upon movement of the printing element to its extended printing position, thereby to emboss indicia I on the tubing. The structure for moving sealing bars 17*a*, 17*b* toward and away from one another and for reciprocating carriage 15 is well known to those skilled in the art and does not constitute a part of this invention. Thus, a detailed description of this structure has been omitted.

Printing head 23 is indexed from one of its printing positions to another printing position in sequence with the order in which scales S1 – S4 deliver their respective batches of product to packages being formed by means of a discrete linear actuator system generally indicated at 39 and generally referred to as index means. This index means is shown to comprise two fluid cylinder units 41 and 43 (see FIGS. 3–5) having a respective cylinder bodies 45 and 46, pistons 47 and 48, and piston rods 49 and 51 extending endwise from one end of their cylinder bodies. Preferably, these fluid cylinder units are double-acting air cylinders. As shown, cylinder unit 41 has a stroke of length A (e.g., one-half inch or 12.7 mm.) and a cylinder unit 43 has a stroke of 2A (e.g., 1 inch or 25.4 mm.). Thus, it will be noted that the stroke of cylinder unit 43 is a whole multiple of the stroke of cylinder unit 41. The cylinder bodies are secured together in back-to-back relation, and the outer end of piston rod 49 of cylinder unit 41 is secured to an abutment member 53 which is fixed to sealing bar 17*a*. The outer end of piston rod 51 is secured to a slide bar 55 connected to printing head 23 for indexing (i.e., reciprocating) the printing head laterally on the sealing bar relative to air cylinder 27. Slide bar 55 is slidably journalled on sealing bar 17*a* by slide bearings 57 and 59. Abutment bar 53 and the above-mentioned slide bearings are part of a stationary frame 61 which is adapted to be removably secured (i.e., bolted) to sealing bar 17*a*.

Air cylinder units 41 and 43 may be selectively actuated singly or in combination with one another so that upon actuation of anyone or both of the air cylinder units, printing head 23 is selectively indexed a distance corresponding to the sum of the strokes of the actuated cylinder units. Thus, by selectively actuating none of the air cylinders, only air cylinder 41, only air cylinder 43, or both air cylinders 41 and 43, printing head 23 may be selectively indexed to any of its printing positions so that printing elements 25*a*–25*d* may each be in position for being actuated by air cylinder 27.

More particularly, when both air cylinders are retracted (see FIG. 3), printing head 23 is in a first printing position in which printing element 25*a* is in register with piston rod 35 of air cylinder 27 for actuation thereby to imprint a code on tubing T. Upon pressurization of only air cylinder 41, its piston rod 47 is extended thereby to move printing head 23 through a distance corresponding to the stroke of air cylinder 41 (e.g., one-half inch) thereby to move the next printing element 25*b* into register with air cylinder 27. Upon pressurization of only air cylinder 43, the printing head is moved a distance corresponding to the stroke of air cylinder 43 which is twice the stroke of air cylinder 41 thereby to move the next or third printing element 25*c* into register with air cylinder 27. And upon pressurization of both air cylinders 41 and 43, printing head is moved a distance corresponding to the sum of both air cylinders so as to align the last printing element 25*d* with air cylinder 27. This last-mentioned printing position is shown in phantom in FIG. 5. Because air cylinders 41 and 43 are double-acting, printing head 23 is positively returned to its first printing position upon the retraction of piston rods 49 and 51.

Packaging machine 1 includes a control or programmer system 63 for controlling operation of scales S1 – S4, of carriage 15, of sealing bars 17*a*, 17*b*, and of coding means 5. Generally, this control system is conventional and is known to those skilled in the art, thus, only portions of the control system will be herein described which are necessary for understanding the operation of coding means 5.

Briefly, programmer system 63 comprises a timing shaft 65 (see FIG. 9) driven by the drive for machine 1 enclosed in base 6. The shaft rotates one revolution for each up and down cycle of carriage 15. Various cams (e.g., cams C1 and C2) are driven by this timing shaft either at the speed of the shaft or at some proportional speed (e.g. one-fourth of the speed). These cams actuate various limit switches (e.g., switches LS10 and LS11) at selected times during cycling of the carriage so as to cause dumping of scales S1 – S4 (if the weight of the batches of product weighed out by the scales exceeds a minimum specified weight) in sequence and in relation to the position of the carriage to effect opening and closing of sealing bars 17*a*, 17*b*, to index printing head 23, and to actuate air cylinder 27 so as to emboss indicia I on the package being formed so as to indicate which scale weighed out the batch of product delivered to that package. It will be understood that the carriage cycles continuously while the packaging apparatus is in operation.

Figure 7:
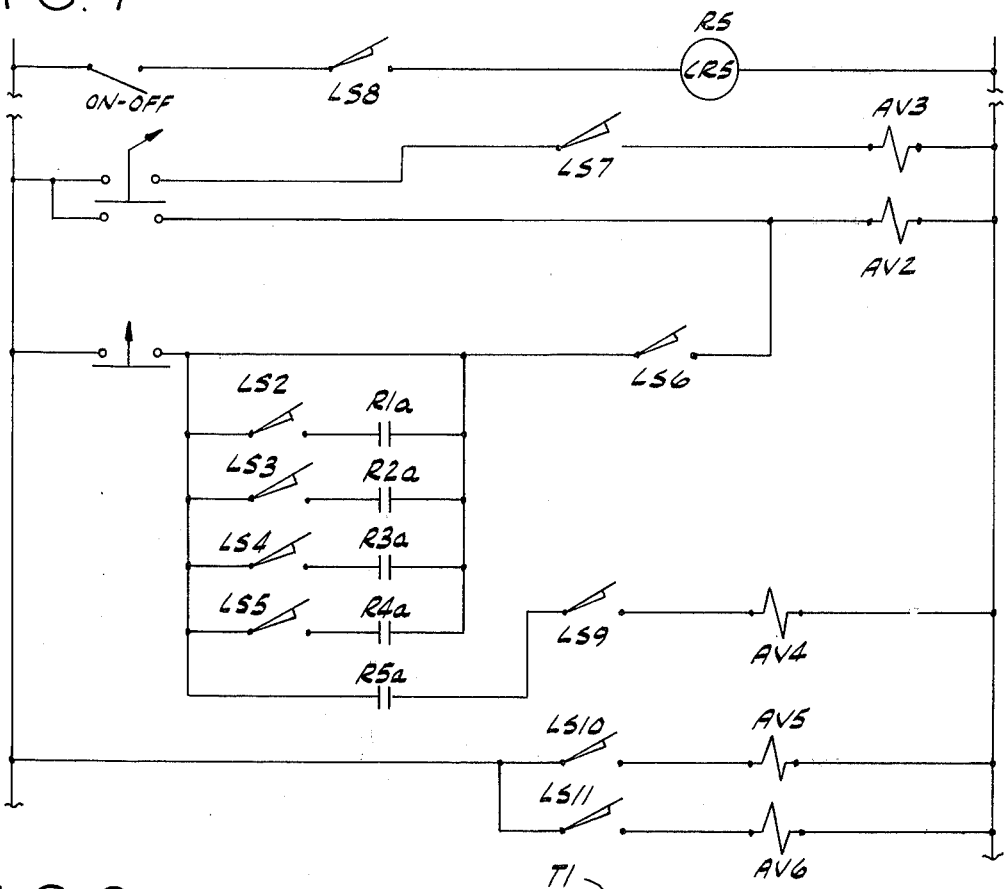
FIG. 7 is a schematic of an electrical circuit for controlling operation of the coding means.
Figure 8:
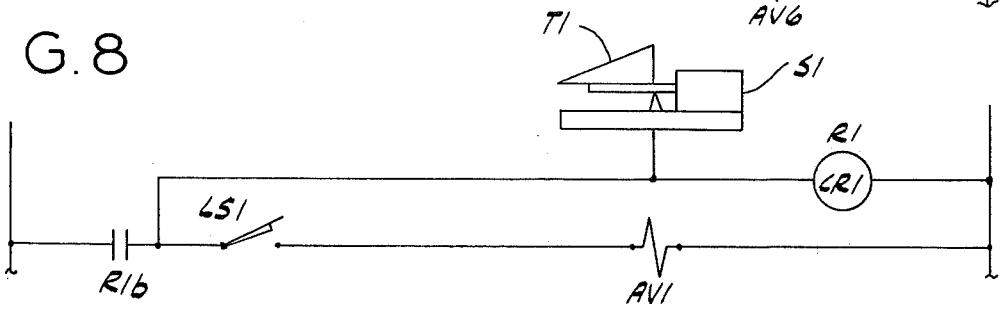
FIG. 8 is an electrical schematic of a circuit which indicates when a scale has weighed out a batch of predetermined weight and which causes the scale to deliver its batch at a prescribed time for delivery to a package.

As previously mentioned, product is automatically delivered to and deposited on trays T1 – T4 of scales S1 – S4 in a manner well known to those skilled in the art. As shown in FIG. 8, when a scale (e.g., scale S1) has had a specified minimum weight of product weighed out on its tray T1 the flow of product to the tray is terminated and a signal is generated indicating that the scale is ready to have its batch of product delivered to a package. This signal energizes the coil CR1 of relay R1 which in turn closes a normally open contact R1*a* (see FIG. 7). Tray T1 of scale S1 is dumped upon energization of a respective solenoid air valve AV1 (see FIG. 8). This air valve is energized by a corresponding limit switch LS1 tripped by movement of carriage 15 so as to effect dumping of tray T1 at a prescribed point in the cycle of the carriage thereby to deliver a batch of product to the next package being formed. Relay R1 has another set of normally open contacts R1*b* which close upon energization of its coil CR1 thereby to enable limit switch LS1 and to latch relay R1. It will be understood that unless the batch of product. weighed out by scale S1 is up to the above-mentioned specified minimum weight, relay R1 will not be energized and thus air valve AV1 will not be actuated by cycling of the carriage. It will be further understood that the other scales S2 – S4 each have a respective relay associated therewith similar to relay R1 and that each of these relays have a respective normally open contact R2*a* – R4*a* (as shown in FIG. 7) and that each of these other relays has contacts similar to contacts R1*b* in series with a respective limit switch and a dump air valve similar to switch LS1 and air valve AV1 to prevent dumping of scale if a batch of product weighed out by the scale is not up to the specified mimimum weight. Thus, if the product weighed out by the scale is not up to weight, that scale will not dump and carriage 15 will idle through a cycle without forming a bag, (i.e., sealing bars 17*a*, 17*b* will not close on tubing T to form a transverse seal across the tubing, and will not pull down at package length interval of tubing from mandrel 9, unless the batch weighed out by the next scale S1 – S4 scheduled to dump is up to its specified minimum weight).

As shown in FIG. 7, each relay contact R1*a* – R4*a* has a respective cam-operated limit switch LS2 – LS5 serially connected thereto. The cams (not shown) controlling actuation of limit switches LS2 – LS5 are driven by timing shaft 65 to close only one limit switch LS2 – LS5 on each cycle of the carriage. These limit switches constitute means for sequentially selecting which scale should dump next and are referred to as dump selector switches. Each scale is selected to dump on every fourth cycle of the carriage. Dump selector switches LS2 – LS5 and their respective dump memory relay contacts R1*a* – $R_4a$ are serially connected to an air valve AV2 which effects closure of sealing bars 17*a*, 17*b* in a manner wellknown in the art. A cam operated limit switch LS6 serially connected between air valve AV2 and the dump memory relay contacts is actuated in timed relation to the cycling of carriage 15 so as to effect closure of the sealing bars as the carriage begins its downstroke. As the carriage reaches its bottom of its downstroke, switch LS6 opens and another cam operated limit switch LS7 closes to energize another air valve AV3 which effects opening of sealing bars.

Air cylinder 27 is actuated to imprint indicia I on a package as it is formed on the closing of sealing bars 17*a*, 17*b*. More specifically, closing of the sealing bars actuates a limit switch LS8 which energizes the coil CR5 of a relay R5 which in turn closes its normally open contact R5*a* thereby to enable a cam operated limit switch LS9. This last-mentioned switch is closed by its respective cam (not shown) driven by timing shaft 65 so as to energize a four-way air valve AV4 which in turn supplies air under pressure to pressurize cylinder 27. With air valve AV4 deenergized, air pressure is supplied to cylinder 27 to retract its piston rod 35 and to hold the latter in its retracted position. It will be noted that limit switch LS7 is actuated by the closing of sealing bar 17*a*, 17*b* and that occurs only if the next scale S1 – S4 scheduled to deliver its batch of product is up to its specified minimum weight.

Figure 9:
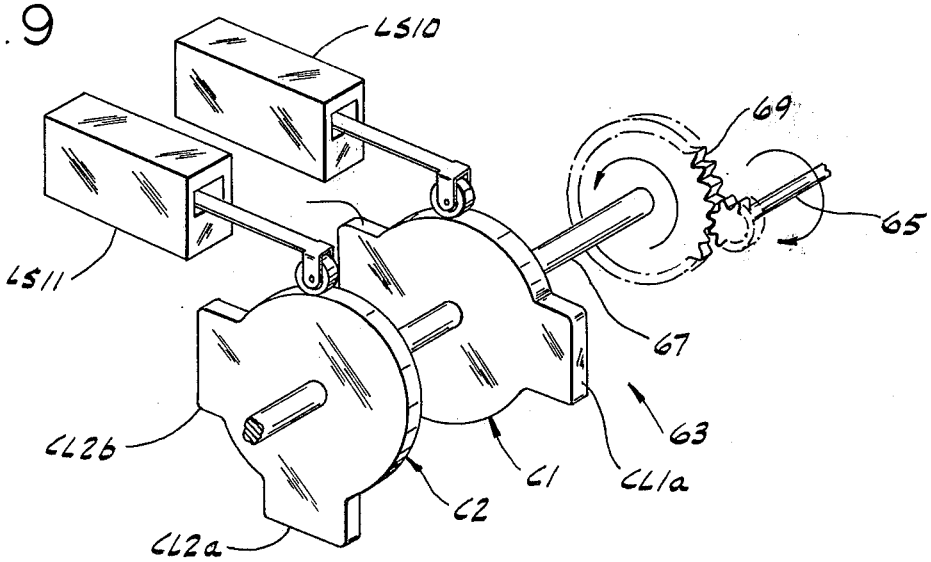
FIG. 9 is a diagrammatic representation of a timing mechanism for controlling indexing of the coding means.

Index means 39 (i.e., air cylinder units 41 and 43) is actuated to discretely index printing head 23 from one of its printing positions to another in sequence with the order in which scales S1 – S4 are scheduled to deliver their respective batches of product by means of a pair of cams C1 and C2 mounted on an auxiliary timing shaft 67 and by a pair of respective limit switches LS10-LS11 actuated by the cams as shown in FIG. 9. Limit switches LS10 and LS11 energize respective four-way, solenoid air valves AV5 and AV6 (see FIG. 7) which respectively supply air to cylinder units 41 and 43 of index means 39 to effect movement of printing head 23 from one printing position to another. With air valves AV5 and AV6 deenergized, their respective air cylinder units 41 and 43 are pressurized to retract their respective piston rods 49 and 51. Shaft 67 is driven by shaft 65 via a speed reducer 69 at one-fourth the rotational speed of shaft 65. Cam C1 has two cam lobes CL1*a* and CL1*b* formed thereon, these cam lobes being spaced 180° from one another, and cam C2 has two cam lobes CL2*a* and CL2*b* spaced 90° from one another. The cams are so mounted on shaft 67 that at the position shown in FIG. 9 (referred to as the zero degree position), none of the cam lobes are in engagement with the actuating arms of switches LS10 and LS11 and thus neither of air valves AV5 or AV6 is energized. This corresponds to a first index position in which printing head 23 is positioned relative to air cylinder 27 so that its printing element is in register with actuating rod 35 of air cylinder 27. Thus, upon pressurization of air cylinder 27, printing element 25*a* is moved axially from its retracted to its printing position so as to imprint indicia I on a bag or package being formed. On the next cycle of carriage 15 the cams will rotate counterclockwise (as shown in FIG. 9) 90° so that cam lobe Cl1*a* trips limit switch LS10 and thus energizes air valve AV5 which in turn pressurizes air cylinder 41 to thereby index printing head 23 to its next printing position in which its printing element 25*b* is in register with actuating rod 35 of air cylinder 27. Printing element 25*b* may, for example, correspond to scale S2. On the next cycle of carriage 15, cams C1 and C2 will have rotated 180° from their position shown in FIG. 9 so that cam lobes Cl1*a* on cam C1 rotates clear of the actuating arm of limit switch LS10 and so that cam lobe Cl2*a* of cam C2 actuates limit switch LS11 thereby to energize air valve AV6 which in turn pressurizes air cylinder 43. Because the stroke of air cylinder 43 is twice the stroke of air cylinder 41, printing head 23 is indexed to its third printing position in which its printing element 23*c* is in alignment with the actuating rod of air cylinder 27. This third printing position may, for example, correspond to delivery of product to the bag being formed by scale S3. Upon the next cycle of carriage 15, cams C1 and C2 will have rotated 270° in counterclockwise direction from the position shown in FIG. 9 so that cam lobes CL1*b* and CL2*b* actuate limit switches LS10 and LS11 thereby to energize both air vlaves AV5 and AV6 so as to actuate both air cylinders 41 and 43. This causes the printing head to move a distance corresponding to the sum of the strokes of air cylinders 41 and 43 thereby to move the fourth printing element 25*d* into register with the actuating rod of air cylinder 35. This fourth printing position corresponds to delivery of product to the package being formed by scale S4. Thus, timing shaft 65, cams C1 and C2 and switches LS10 and LS11 constitute means for effecting operation of index means 39 in accordance with the sequence in which scales S1 – Sx are scheduled to dump. Cams C1 and C2 are preferably mounted on shaft 67 as to actuate index means 39 on the upstroke of carriage 15.

In view of the foregoing, it will be understood that the circuitry shown in FIGS. 7 – 9 and coding means 5 constitute means operable in accordance with the delivery of each batch of product to a package for marking on that package a code designating which scale weighed out that batch.

It will further be understood that using the abovementioned control system, a fifth scale may be accommodated by disabling actuation of air valve AV4 when it was the turn of the fifth scale to deliver its product to the package being formed thereby to prevent actuation of air cylinder 35. In this manner packages containing product weighed out by the fifth scale would have no code marked thereon and thus the absence of a code from the packages would indicate that the fifth scale weighed out the product contained therein.

In accordance with this invention, packaging machines having fewer than four scales may utilize coding means 5 of this invention. For example, a machine having two scales need only have one air cylinder similar to cylinder 41 to constitute its index means. With this one cylinder unactuated, a first printing element, such as element 25*a* of printing head 23, would be in register with the actuating rod of air cylinder 27 to imprint a first code on the package being formed and with the air cylinder actuated, printing head 23 would be shifted to another printing position in which a second printing element such as printing element 25*b*, is in register with the actuating rod of air cylinder 35 for imprinting another code on the bag being formed designating that the product contained in the bags imprinted with that code contains product weighed out by the second scale.

Likewise in a machine having three scales, index means 39 may be constituted by substituting another air cylinder similar to air cylinder 41 in place of air cylinder 43. Thus printing head 23 may be indexed between three printing positions, depending on whether none, one, or both of these identical air cylinders is pressurized.

Also in accordance with this invention coding means 5 may be utilized to indicate information other than which measuring means (e.g, which scale) measured out the product contained in each package. The indicia I on each printing element may, of course, be a series of letters or numbers so that upon actuation of air cylinder 27, a code indicating the date, the lot number of the product contained in the bag, or other information may be embossed or otherwise printed in the seal zone of the bag.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. Packaging apparatus comprising a plurality of means each adapted to measure out a batch of a product for delivery to a package, means for delivering the batch measured out by any one of the measuring means to a package, and means operable in accordance with the delivery of each batch to a package for marking on that package a code designating the particular measuring means which measured out that batch.

2. Apparatus as set forth in claim 1 comprising means for forming packages and filling each package as it is formed, said marking means being operable to mark each package as it is formed.

3. Packaging apparatus as set forth in claim 2 wherein the means for forming the packages comprises means for forming flexible sheet packaging material into tubing and forming transverse seals across the tubing spaced at package-length intervals, said marking means being operable to mark each package as a seal is formed.

4. Packaging apparatus as set forth in claim 3 wherein said forming means comprises a pair of sealing bars relatively movable toward and away from one another for forming said transverse seals and wherein said marking means is carried by said bars.

5. Packaging apparatus as set forth in claim 4 having a vertically reciprocal carriage carrying said bars, the latter closing at the upper end of the carriage stroke and pulling the tubing down one package-length increment on each downstroke of the carriage, and opening for the upstroke of the carriage with the tubing dwelling during the upstroke.

6. Packaging apparatus as set forth in claim 1 wherein said marking means comprises a printing head having a plurality of printing elements selectively actuable to print said code on said package being formed, and means operable in accordance with the delivery of said batch of product to said package being formed for actuating one of said printing elements so as to mark the package with said code.

7. Packaging apparatus as set forth in claim 6 wherein said printing elements are spaced horizontally from one another on said printing head, and wherein said printing head and said actuating means are movable relative to one another between a plurality of printing positions in which said actuating means and a respective printing element are in register with one another for printing said code on said package.

8. Packaging apparatus as set forth in claim 7 further comprising means for forming flexible sheet packaging material into tubing and a pair of sealing bars relatively movable toward and away from one another for forming transverse seals across the tubing at package length intervals, said printing head and actuating means being carried by one of said bars for marking each package as a seal is formed.

9. Packaging apparatus as set forth in claim 8 wherein said actuating means is stationary with respect to said one bar and said printing element is movable laterally with respect to said one bar and relative to said actuating means between its said printing positions.

10. Packaging apparatus as set forth in claim 9 further comprising means for indexing said printing head relative to said actuating means between its said printing positions so that a printing element corresponding to the measuring means which measured out the batch of product filling the package being formed is in position to be actuated by said actuating means.

11. Packaging apparatus as set forth in claim 10 wherein said indexing means comprises at least one fluid cylinder unit having a body and a piston rod movable endwise in and out relative to said body through a stroke of predetermined length, said fluid cylinder unit being interconnected between said one bar and said printing head, said fluid cylinder unit being actuable for moving said printing head from one of its said printing positions to another.

12. Packaging apparatus as set forth in claim 11 wherein said indexing means comprises a pluarlity of said fluid cylinder units secured together in series with one another, said fluid cylinder units being selectively actuable singly or in combination so that upon actuation of one or any combination of said cylinder units, said printing head is selectively indexed a distance corresponding to the sum of the strokes of the actuated cylinder units whereby each of said printing elements may be indexed to its respective printing position relative to said actuating means.

13. Apparatus as set forth in claim 12 wherein one of said cylinder units has a stroke which is a whole multiple of a stroke of another of said cylinder units.

14. Apparatus as set forth in claim 1 wherein said measuring means comprises a plurality of scales.

15. Packaging apparatus as set forth in claim 13 wherein said printing head has four of said printing elements equally spaced from one another, and wherein said indexing means has a first fluid cylinder having a stroke of length A and a second cylinder unit having a stroke of length 2A whereby said indexing means is operable for indexing and printing head relative to said actuator so that each of said printing elements is moved to its respective printing position for being actuated by said actuator.

16. Packaging apparatus as set forth in claim 10 wherein said measuring means sequentially deliver their batches of product one at a time to packages being formed, and wherein said apparatus further comprises means for effecting operation of said index means in accordance with the delivery sequence of said measuring means.

17. Packaging apparatus as set forth in claim 10 further comprising a vertically reciprocable carriage carrying said bars, the latter closing at the upper end of the carriage stroke and pulling the tubing down one package length increment on each downstroke of the carriage, and opening for the upstroke of the carriage with the tubing dwelling during the upstroke, and wherein said indexing means is operable on said upstroke of the carriage.

18. In a form, fill and seal packaging machine in which a web of flexible packaging material is formed into tubing and the tubing is intermittently advanced in package length increments with a dwell between successive feed cycles, transverse seals constituting package end seals being formed across the tubing at package length intervals, said machine having a plurality of scales each adapted to weigh out a batch of product for delivery to a package being formed, means for delivery of the batch weighed out by any one of the scales to a package being formed; wherein the improvement comprises means operable in accordance with the delivery of each batch of product to a package being formed for marking on that package a code designating the particular scale which weighed out that batch.

19. In a form, fill and seal packaging machine as set forth in claim 18, the marking means comprises a printing head having a plurality of selectively actuable printing elements for marking a package, selectively actuable means for actuating one of said printing elements, and means for indexing said printing head relative to said actuating means between a plurality of printing positions at each of which a corresponding printing element is in position with said actuating means for being actuated thereby and for marking said code on a package.

20. In a packaging machine having seal jaws movable toward and away from one another for sealing a package; wherein the improvement comprises means carried by said sealing jaws for marking on a package being formed a code, said coding means comprising a printing head having a plurality of printing elements selectively actuable to print a code on said package being formed, means for actuating one of said printing elements so as to mark said package being formed with said code, said actuating means being secured to one of said sealing jaws, said printing head being movable relative to said one sealing jaw and to said actuating means between a plurality of printing positions in each of which a respective printing element is in position for actuation by said actuating means, and means for indexing said printing head relative to said actuating means between said printing positions.

* * * * *